US005846123A

United States Patent [19]

Brown et al.

[11] Patent Number: 5,846,123

[45] Date of Patent: Dec. 8, 1998

[54] COMPOUNDING ELEMENTS AND USE THEREOF

[75] Inventors: Stuart F. Brown, Warwickshire; Stephen Forbes, Leicestershire, both of England

[73] Assignee: Minnesota Mining and Manufacturing Company, St. Paul, Minn.

[21] Appl. No.: 836,264

[22] PCT Filed: Nov. 16, 1995

[86] PCT No.: PCT/US95/15090

§ 371 Date: May 1, 1997

§ 102(e) Date: May 1, 1997

[87] PCT Pub. No.: WO96/15878

PCT Pub. Date: May 30, 1996

[30] Foreign Application Priority Data

Nov. 18, 1994 [GB] United Kingdom ..... 9423267

[51] Int. Cl.[6] ..... B24B 7/19; B24B 7/30

[52] U.S. Cl. ..... 451/60; 451/523; 451/526; 451/529

[58] Field of Search ..... 451/523, 526, 451/527, 529, 530, 532, 533, 539, 60

[56] References Cited

U.S. PATENT DOCUMENTS

| | | | |
|---|---|---|---|
| 4,689,922 | 9/1987 | Blanchard, Jr. | 451/526 |
| 4,715,150 | 12/1987 | Takeuchi et al. | 451/527 |
| 5,141,555 | 8/1992 | Elepano | 106/10 |
| 5,172,448 | 12/1992 | Kitahata | 451/526 |
| 5,389,032 | 2/1995 | Beardsley | 451/523 |

*Primary Examiner*—David A. Scherbel
*Assistant Examiner*—Derris H. Banks
*Attorney, Agent, or Firm*—William L. Huebsch

[57] ABSTRACT

A compounding element for use with a rubbing compound in the finishing of a working surface. The compounding element has a buffing surface and a resiliently deformable skirt around the perimeter of the buffing surface and projecting beyond the buffing surface. In use, application of pressure to the compounding element on a working surface causes deformation of the skirt so that the buffing surface contacts the working surface and the skirt restricts slinging of the rubbing compounds.

21 Claims, 1 Drawing Sheet

COMPOUNDING ELEMENTS AND USE THEREOF

Figure 1:
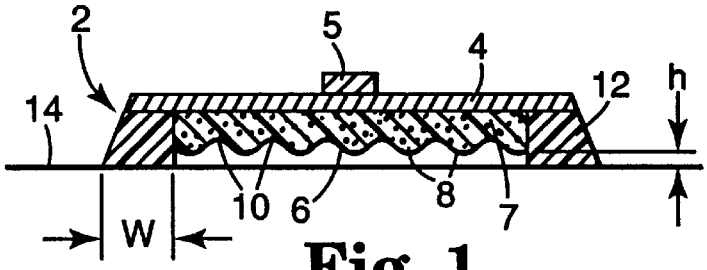

This invention relates to compounding elements or pads and in particular to compounding elements used to finish the exposed surface of paint, such as, on automobiles.

Finishing the exposed surface of new paint such as on an automobile, (particularly paint of the type called BC/CC (basecoat/clearcoat) which is a two-part paint system and is commonly used in after market painting of automobiles but also including other types of paint), typically includes (1) initial colour sanding which is done by hand using fine grit abrasive (e.g., 1200 to 1500 grit) that provides substantial smoothing or leveling of the paint surface but results in surface scratches from the abrasive grit; (2) one or more intermediate compounding operations in which a liquid or paste rubbing compound containing a finer abrasive is applied by a machine rotated compounding pad having tufts of all wool or a wool and synthetic fibre blend to remove the scratches that result from the colour sanding operation, which compounding operation leaves swirl marks on the paint; (3) a machine glazing operation in which a glaze including a yet finer abrasive is applied using a glazing or polishing pad to remove the swirl marks, which machine glazing operation leaves wheel marks that are particularly noticeable on dark colour paints; and (4) a final hand glazing operation in which a glaze including an even finer abrasive is applied by hand in an attempt to remove the wheel marks. Often, the hand glazing operation fills some of the wheel marks rather than removing them, so that after a short period of time or when the paint is subsequently washed, the fill in the wheel marks is removed and they can again be seen.

In addition to the use of compounding or polishing pads comprising wool and synthetic fibres, pads comprising a layer of open cell polymeric foam have been used in compounding and polishing operations. Foam pads are disclosed in U.S. Pat. No. 3,418,675 and foam pads having a working surface defined by a plurality of spaced projecting portions and recesses therebetween are disclosed in U.S. Pat. No. 4,962,562.

One of the problems associated with many known compounding pads is that they have a tendency to sling the rubbing compound onto an area adjacent the working area. This means an operator has to waste valuable time cleaning rubbing compound off adjacent panels, windows and other unmasked areas and also, as a result of sling, much rubbing compound may be wasted. Chemically thickening the rubbing compound can help reduce sling but in many cases this leads to increased drag of the compounding element due to the stiffness of the rubbing compound spreadability.

The present invention provides a compounding element in which the propensity to sling rubbing compound is substantially reduced.

According to the present invention there is provided a compounding element for use with a rubbing compound in the finishing of a working surface. The compounding element comprises a pad forming a buffing surface and a resiliently deformable skirt around the perimeter of the buffing surface and projecting beyond the buffing surface such that, in use, application of pressure to the compounding element on a working surface causes deformation of the skirt so that the buffing surface contacts the working surface.

The compounding element of the invention possesses a skirt which contacts the working surface during the compounding operation and retains the rubbing compound in the vicinity of the buffing surface by providing a barrier to any sling. The skirt projects beyond the buffing surface and when the element is applied to a working surface the skirt contacts the working surface while the buffing surface remains spaced from the working surface. Application of pressure to the compounding element causes the skirt to deform moving the buffing surface in contact with the working surface.

The compound elements of the invention may be used in any of the compounding and glazing operations, the materials of the pads that form the buffing surfaces and the rubbing compounds being selected for the appropriate task. Suitable materials for forming the pads that define the buffing surface of the compound elements include natural fibres, synthetic fibres, combinations thereof and foams, such as those disclosed in U.S. Pat. No. 3,418,675 and U.S. Pat. No. 4,962,562. A material for the pad defining the buffing surface that is useful for applying finishing compounds such as those sold under the commercial designation "Perfect-it" (t.m.) by Minnesota Mining and Manufacturing Company (3M), St. Paul, Minn., to finish the new mar resistant paints is the white colored three dimensional lofty non-woven abrasive which includes a talc abrasive, is generally described in U.S. Pat. No. 3,688,453, and is sold by 3M under the trade designation "Scotch-Brite" (t.m.) cleaning and finishing material. A material for the pad defining the polishing surface that is useful for applying flatting agents (e.g., the material sold under the trade designation "Prep and Blend" (t.m.) by 3M) or for use without such materials to scuff up basecoat/clearcoat paint adjacent a portion of an automobile being repaired to facilitate blending of paint applied to the repaired area with paint already on the lo automobile is the gray colored three dimensional lofty non-woven abrasive which includes silicone carbide abrasive, is generally described in U.S. Pat. No. 2,958,539, and is sold by 3M under the trade designation Ultra Fine Hand Pad No. 7448 "Scotch-Brite" (t.m.) cleaning and finishing material.

The skirt may comprise any resiliently deformable material which does not abrade the working surface more than the buffing surface and rubbing compound. A preferred skirt is made of foam, particularly a soft foam, preferably having open cells. The thickness of the skirt is selected such that it will retain the rubbing compound and will depend upon the resilience of the skirt material, the particular rubbing compound, the amount of rubbing compound used and the action to which the compound element is subjected in use e.g. rotation speed. A suitable foam is an open cell polyester foam having a density in the range of 24 to 27 $Kg/M^3$ such as Type 4200A commercially available from Caligen Foam Ltd, Accrington, U.K. In general foam skirts having a width in the range 5 to 25 mm and projecting 5 to 10 mm beyond the buffing surface have proved to be acceptable, wider skirts being used for compounding element rotated at speeds above 2000 rpm.

The skirt may be made from a strip of foam by joining the ends to form a ring and securing the ring to back-up pad or perimeter of the buffing surface. The ends and ring may be bonded with suitable adhesive or using transfer tape such as 3M No. 9485 Transfer Tape, commercially available from Minnesota Mining and Manufacturing Company (3M), St. Paul, Minn., U.S.A.

In use the rubbing compound is either applied to the buffing surface or the working surface and the compounding element is placed on the working surface such that the skirt envelopes the rubbing compound. The compounding element is subjected to vibratory or rotatory rubbing motion and pressure applied to bring the buffing surface in contact with the working surface. When the desired degree of abrasion has occurred the compounding element may be removed. Alternatively, in the case of a skirt being constructed of a suitable material for buffing or polishing, e.g., a wide skirt of polymeric foam, the pressure on the compounding element may be reduced such that only the skirt contacts the working surface and the rubbing motion continued to buff the surface with the skirt. Thus such a compounding element possesses two separate buffing surfaces.

The compounding element may, optionally, have one or more openings through the pad that defines the polishing surface to afford injecting a cold gas along the polishing surface to cool and thereby facilitate finishing of the surface being polished. WO 94/26476 describes a suitable system that can be used to inject such cold gas.

The invention will now be described with reference to the accompanying drawings in which FIGS. 1, 2, 3 and 4 represent cross-sections through different compounding elements made in accordance with the invention.

In the drawings like reference numerals refer to like parts.

FIG. 1 shows a cross-section through a compounding element 2 in the form of a circular disc. The compounding element 2 comprises a stiff circular backup pad 4 adapted to be rotated by engagement of a drive mechanism (not shown) with a central boss 5 and having attached on its surface opposite the boss 5 a buffing pad 7 defining a buffing surface 6. The buffing pad 7 comprises an open cell polymeric foam and has a plurality of spaced projecting portions 8 and recesses 10 defining the buffing surface 6 as is disclosed in U.S. Pat. No. 4,962,562. A generally cylindrical circumferential skirt 12 surrounds the buffing surface and is formed from a soft polymeric foam. The radial width "w" of the skirt 12 is generally in the range 5 to 25 mm and the skirt 12 projects beyond the buffing surface 6 by a distance "h" which is generally in the range 5 to 10 mm. FIG. 1 shows the compounding element resting on a working surface 14.

With this design, when light pressure is applied to the compounding element 2 the convoluted projections 8 come into contact with the area being compounded and provide the cutting action, whilst the soft foam skirt 12 provides a trap for any sling produced and also helps improve the smooth running of the compounding element. During the compounding operation recesses 10 of the convoluted foam act as mini compound reservoirs as rubbing compound is pushed into the recesses. This means that once the rubbing compound is used up all that needs to be done to release more compound is to stop the machine and apply pressure to the foam to compress the projections 8 to release compound from the recesses.

After all the rubbing compound is used up, pressure on the convoluted projections can be released and the action of the soft foam skirt 12 on the paint surface 14 aids in the clean up of any excess oils from the rubbing compound whilst polishing the surface to a high luster finish. Using this design of compounding element 2, it is possible (depending on the rubbing compound used) to obtain a finish on a single colour black paint which requires no further refining, i.e., it is possible to achieve a one-step finishing operation.

Figure 2:
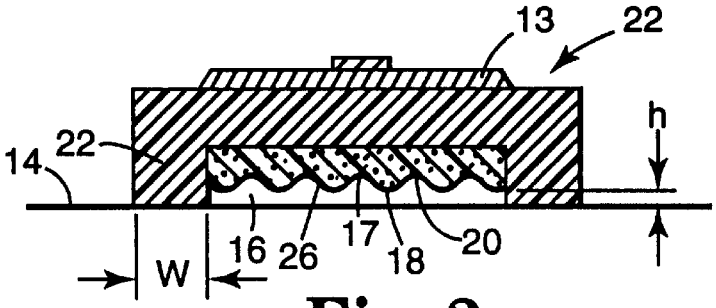

FIG. 2 shows a compounding element 22 according to the present invention that is formed by modification of a cylindrical soft foam buff to which is attached a back up pad 13 by which the compounding element 22 is driven. A cylindrical central portion 16 of that soft foam flat buff was cut out to such a depth as to allow a convoluted hard foam buffing pad 17 having spaced projections 18 and recesses 20 that define a buffing surface 26 to sit just below the distal surface of a peripheral portion of the buff that forms a skirt 22. The mode of operation is identical to that described with respect to FIG. 1. An advantage of this design is that the buffing pad 17 defining the buffing surface 26 can be removed and replaced with a different material e.g. wool/polyester blend mop or a softer (or harder) convoluted foam.

Figure 3:
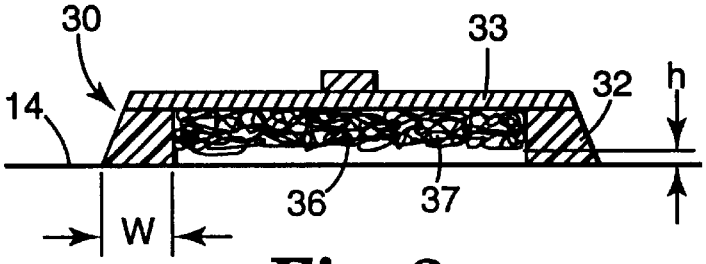

FIG. 3 shows a compounding element 30 according to the present invention that has a foam skirt 32 surrounding a sliver knit wool/polyester blend mop or buffing pad 37 pad that defines a buffing or polishing surface 36, which skirt and buffing pad 37 are attached to a back up pad 33 by which the compounding element 30 is driven.. This design produces a higher degree of aggression compared to the use of foam.

Figure 4:
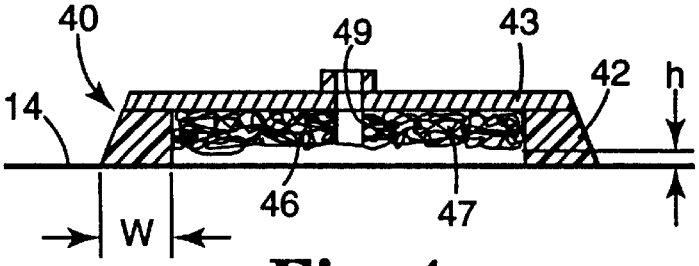

FIG. 4 shows a compounding element 40 according to the present invention that has a foam skirt 42 surrounding a buffing pad 47 defining the buffing surface 46, which skirt 42 and buffing pad 47 are attached to a back up pad 43 by which the compounding element 40 is driven. The buffing pad 47 can be made of the three dimensional lofty non-woven abrasive which includes a talc abrasive and is sold by 3M under the trade designation "Scotch-Brite" (t.m.) cleaning and finishing material. With a buffing pad 47 of such material the compounding element 40 is useful for applying finishing compounds such as those sold under the commercial designation "Perfect-it" (t.m.) by Minnesota Mining and Manufacturing Company (3M), St. Paul, Minn., to finish the new mar resistant paints. Alternatively the buffing pad 47 defining the buffing surface 46 could be formed of the three dimensional lofty non-woven abrasive which includes silicone carbide abrasive and is sold by 3M under the trade designation Ultra Fine Hand Pad No. 7448 "ScotchBrite" (t.m.) cleaning and finishing material. With a pad of such material the compounding element is useful for applying flatting agents (e.g., the material sold under the trade designation "Prep and Blend" (t.m.) by 3M) or for use without such materials to scuff up basecoat/clearcoat paint adjacent a portion of an automobile being repaired to facilitate blending of paint applied to the repaired area with paint already on the automobile.

The compounding element 40 has a central opening 49 (e.g., a cylindrical opening 49 having a diameter in the range of about 1.9 to 25 mm or 22 mm) through the buffing pad 47 that defines the buffing surface 46 which is aligned with a central opening in the back up pad 43 to afford injecting a cold gas through the buffing pad 47 and along the buffing surface 46 to cool and thereby facilitate finishing of the surface being polished.

Whilst the compounding elements 2, 22, 30 and 40 have been illustrated in the form of discs e.g. 5¼ inch discs which are a standard size used in the art, alternatively the compounding elements could take a variety of different shapes e.g. square, rectangular, oval etc. depending upon the manner in which they will be driven e.g. manually, or by rotary machines etc. Furthermore the compounding elements may be constructed to allow detachable fastening of the skirt and/or buffing surface to the back-up pad e.g. employing hook and loop fastening devices, mechanical fastening devices, pressure sensitive adhesives etc.

The present invention has now been described with reference to four embodiments thereof. It will be apparent to those skilled in the art that many changes can be made in the embodiments described without departing from the scope of the present invention. For example, any of the compounding elements could include a buffing pad with either a planar polishing surface as illustrated in FIGS. 3 and 4 for the compounding elements 30 and 40, or a polishing surface defined by projections and recesses as illustrated in FIGS. 1 and 2 for the compounding elements 2 and 22. As a further example, any of the compounding elements 2, 12 or 30 could have a through opening for the injection of cold gas such as the opening 49 in the compounding element 40. Thus, the scope of the present invention should not be limited to the structures and methods described in this application, but only by the structures and method described by the language of the claims and the equivalents thereof.

We claim:

1. A compounding element for use with a rubbing compound in the finishing of a working surface, the compounding element comprising a buffing pad having a buffing surface and a skirt of resiliently deformable polymeric foam around the perimeter of the buffing surface, said skirt projecting beyond the buffing surface and having a distal surface, with area of the distal surface of the skirt being smaller than the area of the buffing surface of the buffing pad such that, in use, application of pressure to the compounding element on a working surface causes deformation of the skirt so that the buffing surface contacts the working surface and the skirt will help to retain a rubbing compound between the buffing surface and the working surface.

2. A compounding element according to claim 1 in which the buffing pad defining said buffing surface comprises natural fibres, synthetic fibres, polymeric foam or any combination thereof.

3. A compounding element according to claim 1 in which the buffing pad defining said buffing surface comprises three dimensional lofty non-woven abrasive.

4. A compounding element according to claim 1 in which said buffing pad has an opening through said buffing surface through which opening cold gas may be injected along said buffing surface.

5. A compounding element according to claim 1 in which the buffing pad defining the buffing surface comprises a polymeric open cell foam and has a plurality of projections with recesses therebetween defining said buffing surface.

6. A compounding element according to claim 1 wherein said skirt has a width normal to said perimeter and in a plane generally parallel to said buffing surface of from about 5 to 25 mm (0.2 to 1 inch).

7. A compounding element according to claim 1 in which the skirt projects beyond the buffing surface by a distance of from about 5 to 10 mm (0.2 to 0.4 inch).

8. A compounding element according to claim 1 including a stiff back-up pad on the side of the polishing pad opposite the buffing surface.

9. A compounding element according to claim 8 in which the buffing pad defining the buffing surface is removable from the skirt.

10. A compounding element as claimed in claim 8 in which the buffing pad and the skirt are detachable from the back up pad.

11. A compounding element according to claim 1 that is in the form of a disc.

12. A method of treating a working surface comprising the steps of:

(i) providing a compounding element comprising a buffing pad having a buffing surface, and a resiliently deformable skirt around the perimeter of the buffing surface projecting beyond the buffing surface and having a distal surface, with the area of the distal surface of the skirt being smaller than the area of the buffing surface of the buffing pad, (ii) applying a rubbing compound to the working surface to be treated and/or the buffing surface of the compounding element, and (iii) contacting the compounding element on the working surface and applying pressure to deform the skirt and bring the buffing surface in contact with the working surface to abrade the working surface while the skirt helps to retain the rubbing compound between the buffing surface and the working surface.

13. A method according to claim 12 wherein the buffing pad in the compounding element is circular and has a diameter of about 133.4 mm (5.25 inches), the skirt has a width normal to the perimeter of the buffing pad and in a plane generally parallel to the buffing surface of from about 5 to 25 mm (0.2 to 1 inch), and the compounding element is rotated during said contracting step so that the skirt restricts slinging of the rubbing compound radially of the compounding element.

14. A compounding element adapted to be rotated and used with a rubbing compound in the finishing of a working surface, the compounding element being in the shape of a circular disc having an axis, said compounding element comprising a circular buffing pad having a buffing surface and a diameter of about 133.4 mm (5.25 inches) and a generally cylindrical skirt of resiliently deformable polymeric foam around the perimeter of the buffing surface, said skirt having a width radially of the compounding element of from about 5 to 25 mm (0.2 to 1 inch) and projecting beyond the buffing surface by a distance of from about 5 to 10 mm (0.2 to 0.4 inch) such that, in use, application of pressure to the compounding element on a working surface causes deformation of the skirt so that the buffing surface contacts the working surface and the skirt will help to retain the rubbing compound between the buffing surface and the working surface during rotation of the compounding element to finish the working surface.

15. A compounding element according to claim 14 in which the buffing pad defining said buffing surface comprises natural fibres, synthetic fibres, polymeric foam or any combination thereof.

16. A compounding element according to claim 14 in which the buffing pad defining said buffing surface comprises three dimensional lofty non-woven abrasive.

17. A compounding element according to claim 14 in which said buffing pad has an opening through said buffing surface through which opening cold gas may be injected along said buffing surface.

18. A compounding element according to claim 14 in which the buffing pad defining the buffing surface comprises a polymeric open cell foam and has a plurality of projections with recesses therebetween defining said buffing surface.

19. A compounding element according to claim 14 including a stiff back-up pad on the side of the polishing pad opposite the buffing surface.

20. A compounding element according to claim 14 in which the buffing pad defining the buffing surface is removable from the skirt.

21. A compounding element as claimed in claim 14 in which the buffing pad and the skirt are detachable from the back up pad.

* * * * *